US008250762B2

(12) United States Patent
Tamai

(10) Patent No.: US 8,250,762 B2
(45) Date of Patent: Aug. 28, 2012

(54) METHOD OF MANUFACTURING METAL MEMBER WITH PLURALITY OF PROJECTIONS

(75) Inventor: Jun Tamai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 12/743,638

(22) PCT Filed: Jan. 21, 2009

(86) PCT No.: PCT/JP2009/051288

§ 371 (c)(1),
(2), (4) Date: May 19, 2010

(87) PCT Pub. No.: WO2009/093741

PCT Pub. Date: Jul. 30, 2009

(65) Prior Publication Data

US 2010/0251549 A1 Oct. 7, 2010

(30) Foreign Application Priority Data

Jan. 25, 2008 (JP) ..... 2008-014459

(51) Int. Cl.
*B21D 53/28* (2006.01)
*B23P 15/14* (2006.01)

(52) U.S. Cl. ..... 29/893.33; 29/893.34; 29/893; 72/380; 72/386; 72/387; 72/389.1

(58) Field of Classification Search ..... 29/893, 29/893.32, 893.33, 893.34, 893.36, 894; 72/335, 340, 351, 356, 358, 380, 386, 387, 72/389.1

See application file for complete search history.

(56) References Cited

U.S. PATENT DOCUMENTS

| | | | | | |
|---|---|---|---|---|---|
| 1,670,475 | A | * | 5/1928 | Nicholson | 29/893.33 |
| 1,847,926 | A | * | 3/1932 | Chase | 29/893.33 |
| 4,876,876 | A | * | 10/1989 | Ishida et al. | 72/348 |
| 5,125,256 | A | * | 6/1992 | Ohkubo et al. | 72/340 |
| 5,237,745 | A | * | 8/1993 | Yamanaka | 29/893.34 |
| 5,347,192 | A | * | 9/1994 | Mukohjima et al. | 310/323.04 |
| 5,878,493 | A | * | 3/1999 | Himmeroeder | 29/893.35 |

(Continued)

FOREIGN PATENT DOCUMENTS

FR 2 524 354 A 10/1983

(Continued)

OTHER PUBLICATIONS

Notification of Transmittal of the International Search Report and the Written Opinion of the International Searching Authority in related corresponding International Appln. No. PCT/JP2009/051288.

(Continued)

*Primary Examiner* — Derris Banks
*Assistant Examiner* — Kaying Kue
(74) *Attorney, Agent, or Firm* — Fitzpatrick, Cella, Harper & Scinto

(57) ABSTRACT

Projections of a bevel gear or a vibrating body are formed by bending a metal-made plate member having a plurality of projections so as to direct them in the same direction and make their projecting direction include a component of out-of-plane direction and subsequently applying a load to the bent plate member to crush the projections so as to reduce the height thereof and increase the plate thickness.

7 Claims, 13 Drawing Sheets

U.S. PATENT DOCUMENTS

| | | | | |
|---|---|---|---|---|
| 5,904,060 | A * | 5/1999 | Kanemitsu et al. | 72/110 |
| 6,016,602 | A * | 1/2000 | Kanemitsu et al. | 29/893.32 |
| 6,198,202 | B1 * | 3/2001 | Tamai et al. | 310/323.15 |
| 6,868,606 | B2 * | 3/2005 | Friese | 29/893.32 |
| 7,047,781 | B1 * | 5/2006 | Kanemitsu et al. | 72/110 |
| 7,181,945 | B2 * | 2/2007 | Park et al. | 72/84 |
| 7,189,163 | B2 * | 3/2007 | Nagayama | 470/25 |
| 7,296,456 | B2 * | 11/2007 | Ushida | 72/356 |

FOREIGN PATENT DOCUMENTS

| | | | |
|---|---|---|---|
| JP | 01-133615 | A | 5/1989 |
| JP | 03-094949 | A | 4/1991 |
| JP | 04-327335 | A | 11/1992 |
| JP | 07-135785 | A | 5/1995 |
| JP | 10-146642 | A | 6/1998 |
| JP | 11-188449 | A | 7/1999 |
| JP | 11-277177 | A | 10/1999 |
| JP | 2000-024745 | A | 1/2000 |
| JP | 2000-343177 | A | 12/2000 |
| JP | 2001-047167 | A | 2/2001 |
| JP | 2001-047175 | A | 2/2001 |
| JP | 2001-205385 | A | 7/2001 |
| JP | 2002-066676 | A | 3/2002 |
| JP | 2004-291007 | A | 10/2004 |

OTHER PUBLICATIONS

E. Korner, et al., "Halbwarmfliesspressen Kombiniert Mit Kaltfliesspressen", Werkstatt Und Betrieb, Carl Hanser Verlag, Munchen, Sep. 1, 1993, pp. 557-560, vol. 126, No. 9, XP000411627.

* cited by examiner

METHOD OF MANUFACTURING METAL MEMBER WITH PLURALITY OF PROJECTIONS

TECHNICAL FIELD

This invention relates to a method of manufacturing a metal member having a plurality of projections such as a bevel gear or a vibrating body of an ultrasonic motor where the projections amplify vibrations.

BACKGROUND ART

Techniques for punching a metal plate member in order to form a sprocket wheel having radial projections are known. However, punching is not suited for forming a bevel gear having teeth projecting in a direction that crosses radial directions, although a bevel gear is also a gear.

Grinding and cutting are known as techniques for cutting grooves to produce teeth in order to form a bevel gear. Forging and sheet metal stamping using a press device are also known as techniques for forming a bevel gear (refer to, e.g., Japanese Patent Application Laid-Open Nos. H11-188449 and 2001-205385).

The process of forming teeth of a bevel gear can be simplified by using the forging or sheet metal stamping technique to reduce the manufacturing cost if compared with the process of forming such teeth by using the grinding or cutting technique. Therefore, sheet metal stamping or forging is advantageous relative to grinding or cutting for forming bevel gears on a mass production basis from the viewpoint of manufacturing cost.

Members having a plurality of projections that look like teeth projecting in the same direction include, besides a bevel gear, a vibrating body of an ultrasonic motor having projections for amplifying vibrations. An ultrasonic motor has a vibrating body equipped with a piezoelectric element, which is a sort of electro-mechanical transducer, and is designed to generate a traveling wave on the surface of the vibrating body by supplying an alternating signal to the piezoelectric element and drive a moving body held in contact with the vibrating body by utilizing the traveling wave. Projections are formed on the surface of the vibrating body in order to boost the amplitude of the traveling wave generated on the surface of the vibrating body. Sheet metal stamping and forging using a press device are known as techniques for forming projections for amplifying the vibrations of the vibrating body (refer to, e.g., Japanese Patent Application Laid-Open No. H07-135785).

A press die having fins for forming grooves has to be provided in order to form a large number of teeth or projections projecting in the same direction on the surface of a metal object to be worked by forging or sheet metal stamping.

FIG. 21 is a schematic illustration of forming grooves on an object to be worked by sheet metal stamping. FIG. 21 illustrates a metal object 93 to be worked and fins 97*a* of a metal die.

Grooves are formed by applying a load on the metal object 93 to be worked by means of the fins 97*a*. In other words, the fins 97*a* are subjected to a heavy load. When narrow grooves are to be formed, thin fins 97*a* need to be used to form such narrow grooves. Then, the strength of the fins 97*a* is reduced so that the fins 97*a* may highly possibly be damaged when they are used for forging or sheet metal stamping. Therefore, the width of the grooves to be formed needs to have a certain large value in order to make the fins 97*a* show a certain degree of strength. Thus, the width of the projections of a bevel gear or a vibrating body to be formed in this way is subjected to a certain limitation.

Even if the metal die has a strength that is sufficient for bearing a single compression forming process, it is clear that the load to be applied in a single compression forming process is preferably small from the viewpoint of repeatedly using the metal die for compression forming. For this reason, the projections of a bevel gear or a vibrating body to be formed on a mass production basis are subjected to limitations in terms of their profile in order to reduce the load to be applied to the metal die.

Thus, the currently available methods of manufacturing a metal member having a plurality of projections have much room for improvement from the viewpoint of easily forming a plurality of projections projecting in the same direction with a desired width and reducing the load to be applied to the metal die in a compression forming process.

DISCLOSURE OF THE INVENTION

According to the present invention, the above-identified problem is dissolved by providing a method of manufacturing a metal member having a plurality of projections that includes: a step of bending a plurality of projections of a metal-made plate member having the plurality of projections so as to make their projecting direction include the component of out-of-plane direction; and a step of applying a load having the component of out-of-plane direction to the plurality of projections to increase the plate thickness of the plurality of projections.

Thus, according to the present invention, the load applied to the metal die at the time of compression forming can be suppressed and the grooves among the projections can be formed with a desired width without resorting to grinding and/or cutting when forming a metal member having a plurality of projections.

BEST MODE FOR CARRYING OUT THE INVENTION

Now, exemplary embodiments of the present invention will be described in greater detail by referring to the accompanying drawings.

First Embodiment

The first embodiment of a method of manufacturing a metal member having a plurality of projections projecting in the same direction will be described in terms of a vibrating body having projections on the surface thereof for amplifying vibrations that is to be used for an ultrasonic motor. The ultrasonic motor has a vibrating body equipped with a piezoelectric element, which is a sort of electro-mechanical transducer, and is designed to generate a traveling wave on the surface of the vibrating body by supplying an alternating signal to the piezoelectric element and drive a moving body held in contact with the vibrating body by utilizing the traveling wave.

Now, this embodiment of a method of forming projections for amplifying vibrations on a vibrating body will be described below by referring to FIGS. 1 through 7.

Figure 1:
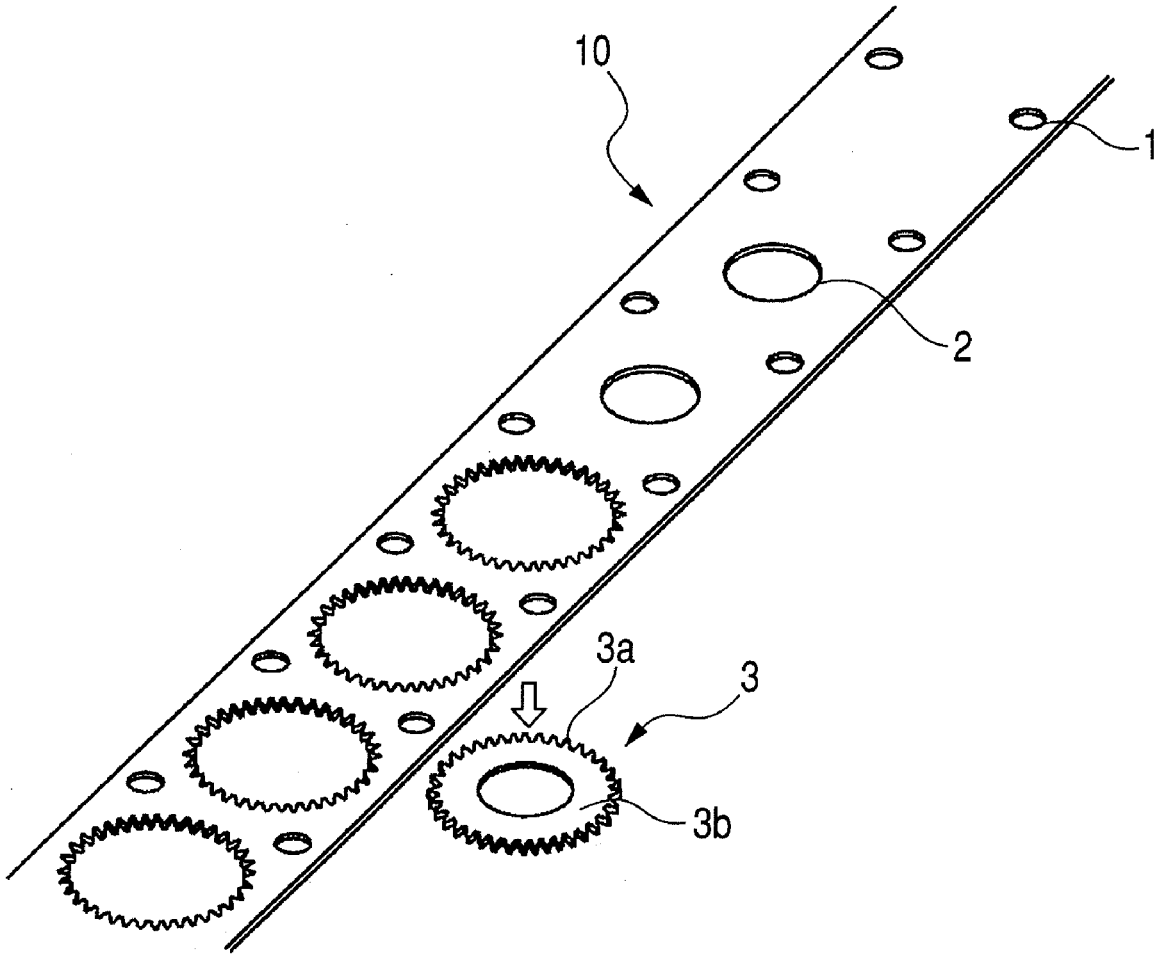
FIG. 1 is a schematic illustration of the step of punching out a sprocket-shaped member from a plate member in a first embodiment of the present invention.

FIG. 1 is a schematic illustration of the step of punching out a sprocket-shaped member from a metal plate member. FIG. 1 illustrates a stainless steel plate member 10 that is conveyed gradually in a longitudinal direction. The plate member may be made of SPC material, low alloy steel, high alloy steel or a non-ferrous metal alloy. Pilot holes 1 are punched through the plate member 10 at regular intervals by means of an apparatus that is not illustrated here. The pilot holes 1 operate as positioning holes in a subsequent sheet metal stamping step.

Then, inner holes 2 are punched out for a centering operation that takes place in a subsequent press-drawing step. Each inner hole 2 is positioned by referring to a positioning punch put into a pilot hole 1.

Thereafter, a punching position is determined by referring to the pilot hole 1 by means of the punch and a circular sprocket-shaped plate member 3 having a ring-like base section 3*b* and a plurality of projections 3*a* respectively along the inner periphery and the outer periphery thereof is punched out. As a result, the sprocket-shaped plate member 3 and the inner hole 2 are made to be highly coaxial. The plate member has a profile having projections projecting in different in-plane directions.

Figure 2:
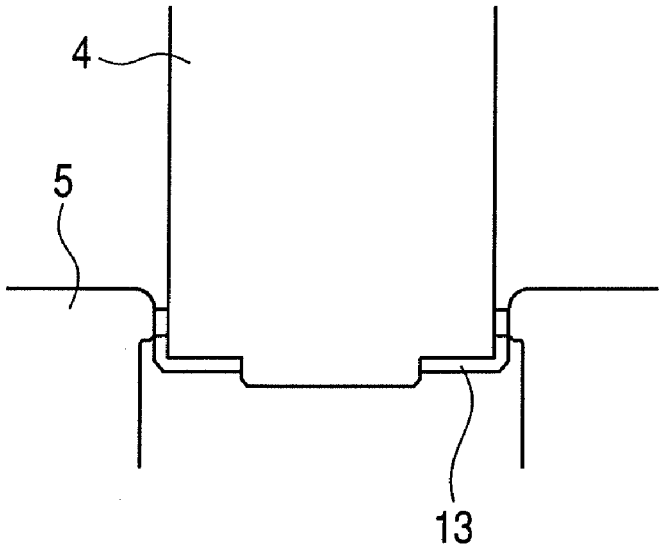
FIG. 2 is a schematic illustration of the step of deforming a sprocket-shaped member to produce a crown-shaped member by press-drawing in the first embodiment.

FIG. 2 is a schematic illustration of the step of deforming the sprocket-shaped member 3 to produce a crown-shaped member 13 by press-drawing.

FIG. 2 illustrates a punch 4 and a die 5. The punch 4 has a stepped section at the front end thereof to be engaged with the inner hole 2 of the sprocket-shaped member 3. As the stepped section of the punch is engaged with the inner hole 2, the sprocket-shaped member 3 can be positioned correctly for press-drawing. However, the sprocket-shaped member 3 may not be provided with an inner hole 2 when the die 5 has a member for positioning the sprocket-shaped member 3.

As the punch 4 that is engaged with the inner hole 2 is lowered, the sprocket-shaped member 3 is drawn into the gap between the punch 4 and the die 5 until the outer peripheral part of the sprocket-shaped member 3 where the projections are formed is bent orthogonally along a line slightly inner relative to the bases of the projections to produce a crown-shaped member 13 showing a cylindrical profile. The projections are directed in an out-of-plane direction without grinding and/or cutting by bending the plate member having projections.

Figure 3:
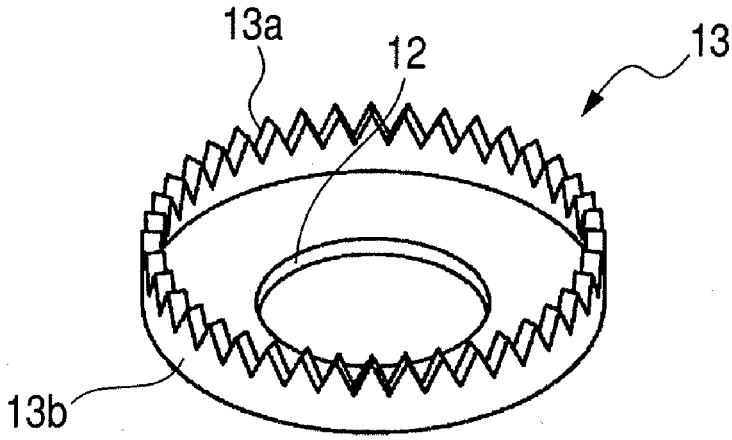
FIG. 3 is a schematic illustration of a crown-shaped member produced in the first embodiment, illustrating an appearance thereof.

FIG. 3 is a schematic illustration of such a crown-shaped member 13, illustrating an appearance thereof. As a sprocket-shaped member 3 is subjected to press-drawing, the projections 13*a* that are arranged circularly around the central axis of the crown-shaped member 13 are made to project from the base section 13*b* in a same and identical direction running along the central axis of the member 13. An inner hole 12 is the same as the inner hole 2 of the sprocket-shaped member 3.

Since the outer peripheral part of the sprocket-shaped member 3 is made to shrink by the press-drawing, the intervals of the projections 13*a* of the crown-shaped member 13 are made smaller than the intervals of the projections 3*a* of the sprocket-shaped member 3. This is advantageous from the viewpoint of forming a vibrating body having projections with circumferential narrow grooves that separate the projections because the load of formation in a subsequent forging step is reduced when the grooves are narrowed in advance.

Figure 4:
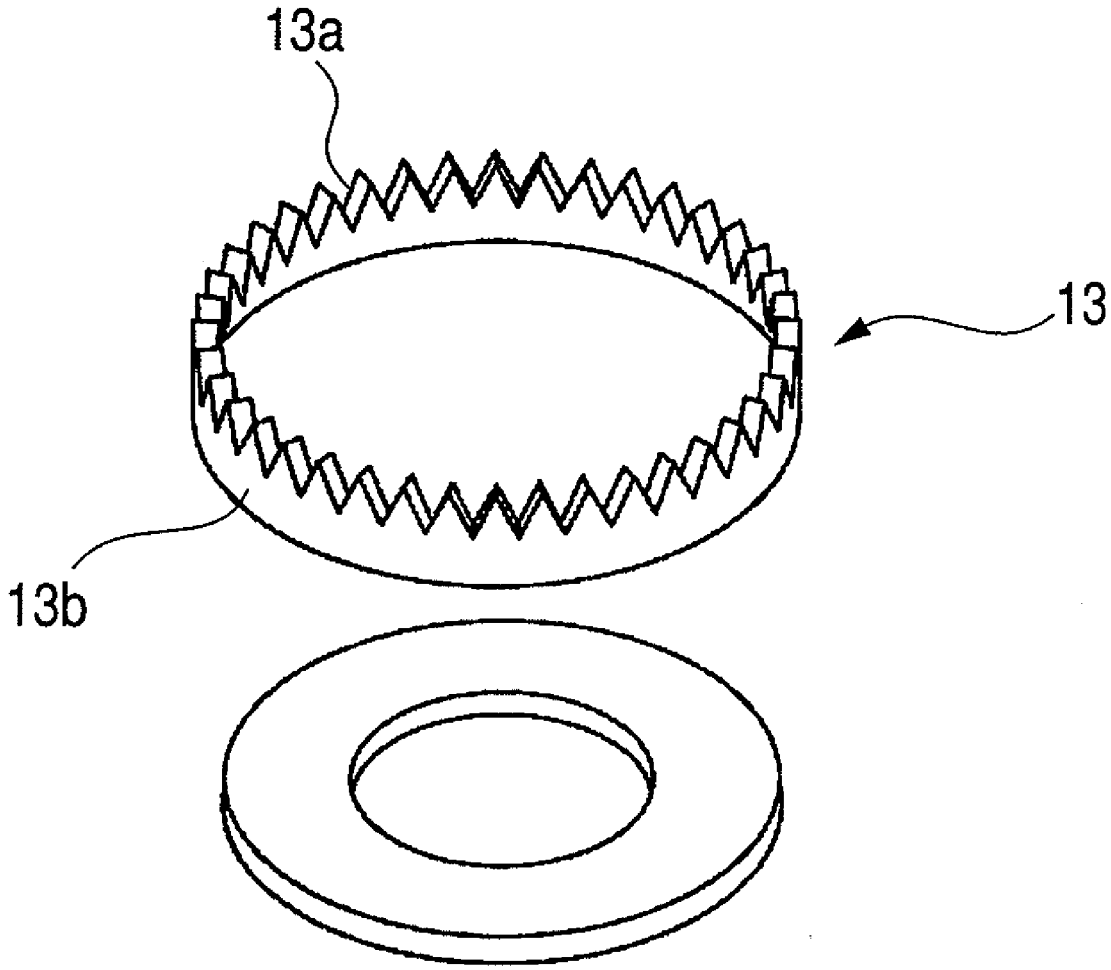
FIG. 4 is a schematic illustration of punching out a bottom part of the crown-shaped member of FIG. 3.

Then, the ring-like crown-shaped member 13 is made to show a profile as illustrated in FIG. 4 by punching out the bottom of the crown-shaped member 13. The operation of punching out the bottom of the crown-shaped member 13 may not be necessary depending on the desired profile of the vibrating body to be produced.

The crown-shaped member 13 whose bottom is punched out is then subjected to an annealing heat treatment so as to be softened for the purpose of reducing the load of formation and making it easy to plastically deform the crown-shaped member 13 in a subsequent forging step. The annealing heat treatment may be omitted depending on the degree of drawing particularly when the material is not hardened excessively and the resistance of the material against deformation is not so large.

The surface of the crown-shaped member 13 that is softened by the annealing heat treatment is then lubricated. Then, the crown-shaped member 13 is subjected to forging.

Figure 5:
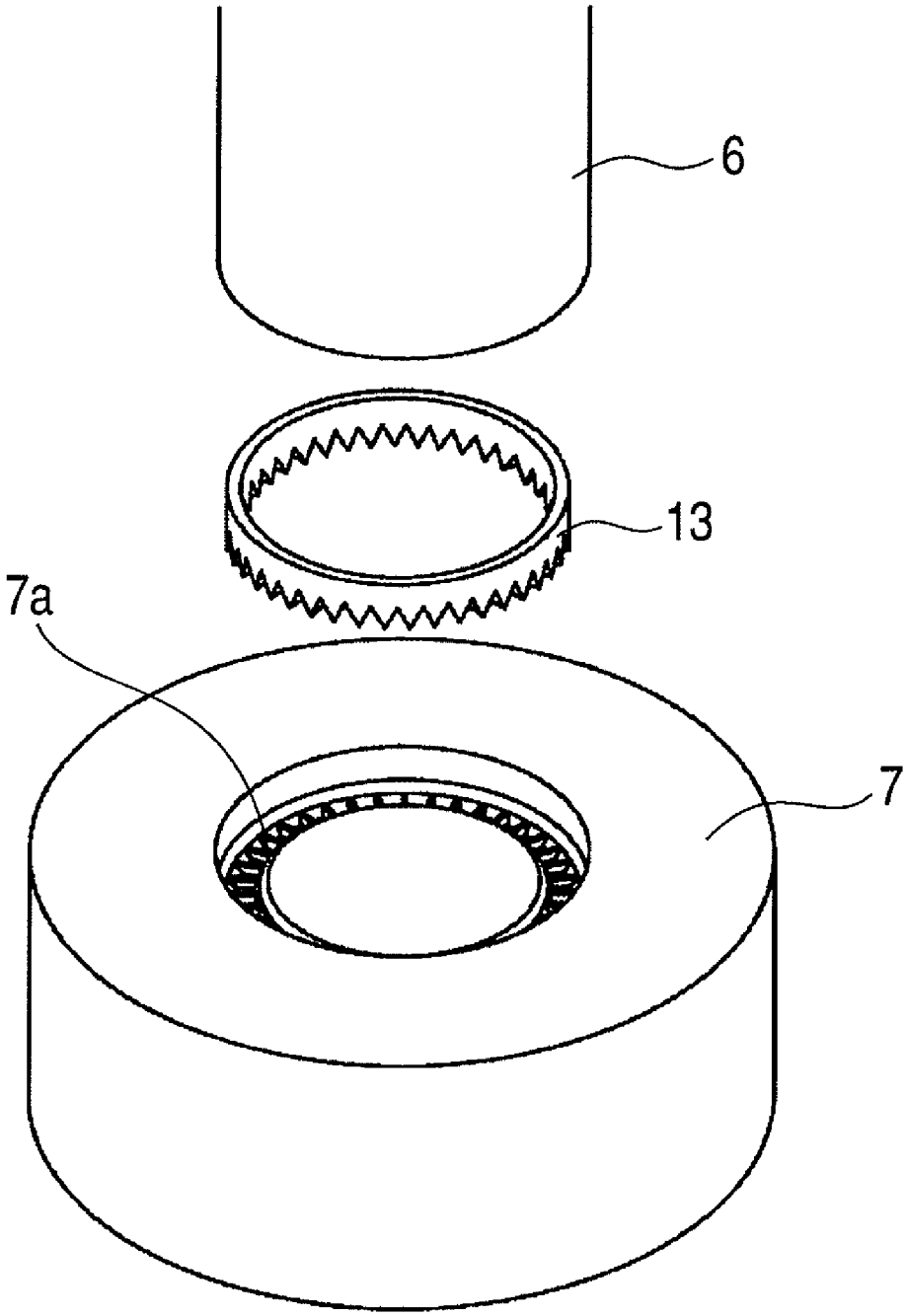
FIG. 5 is a schematic illustration of the step of forging a crown-shaped member in the first embodiment.

FIG. 5 is a schematic illustration of the step of forging a crown-shaped member 13. In this embodiment, the crown-shaped member 13 is turned upside down and a load is applied thereto for forging, or compression forming, in the projecting direction of the projections 13*a* along the axis of the crown-shaped member 13. The lower metal die to be used for the forging is provided with a plurality of fins 7*a*, which fins 7*a* define the profile of the grooves separating the projections of a vibrating body for amplifying vibrations of the vibrating body.

Figure 6:
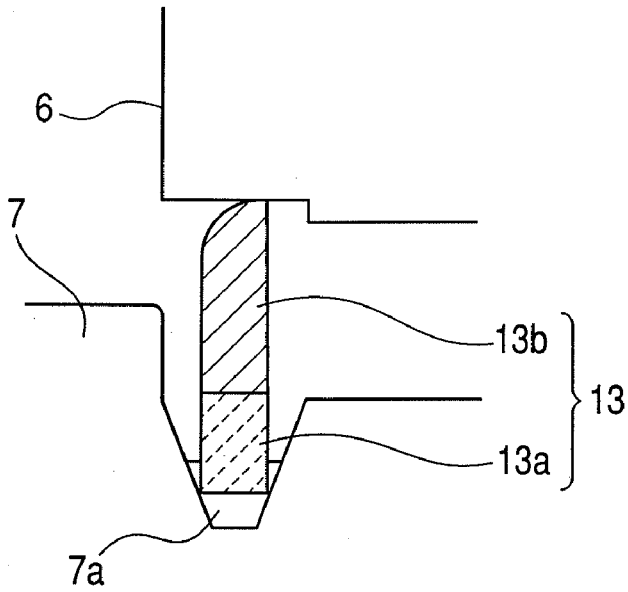
FIG. 6 is a schematic cross-sectional view of a punch, a die and a crown-shaped member before the crown-shaped member is forged in the first embodiment.
Figure 7:
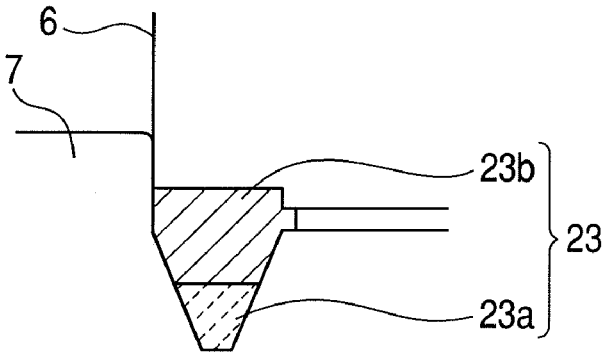
FIG. 7 is a schematic cross-sectional view of a vibrating body formed by forging by the first embodiment of the present invention.

FIG. 6 is a schematic cross-sectional view of a punch 6, a die 7 and a crown-shaped member 13 before being forged. FIG. 7 is a schematic cross-sectional view of a vibrating body 23 formed by forging.

In this embodiment, the lower metal die 7 is provided with circularly arranged grooves into which the projections 13*a* of the crown-shaped member 13 are inserted respectively. Fins 7*a* are arranged at regular intervals in the respective grooves that are circularly arranged. Both the outer peripheral walls and the inner peripheral walls of the grooves are sloped such that the radial width of the grooves is reduced toward the bottoms of the grooves and the width of the grooves at the bottoms thereof is smaller than the plate thickness of the projections 13*a*. A base section 13*b* of a projection 13*a* is located between the base of the projection 13*a* and the part thereof that is bent by drawing.

Since the inner peripheral walls and the outer peripheral walls of the die 7 are sloped, center position of the crown-shaped member is automatically aligned with that of the die 7 to secure a high degree of dimensional precision of the formed product.

After circumferentially positioning the crown-shaped member 13 so as to place each of the projections 13*a* of the crown-shaped member 13 between a pair of adjacently located fins 7*a* of the die 7, the punch 6 is lowered to compression-forming the crown-shaped member 13.

Due to the forging and the resultant compression forming, the radial width and hence the plate thickness of the projections 13*a* and the base sections 13*b* of the crown-shaped member 13 are increased so that the crown-shaped member 13 is deformed so as to show a profile with a thickness as large as the gaps between the outer peripheral walls and the inner peripheral walls. Then, as a result, a vibrating body 23 having projections 23*a* and base sections 23*b* is produced with a profile as illustrated in FIG. 7. Since the volume of the crown-shaped member 13 may show a variance, the metal die is so designed in this embodiment that the excessive thickness, if any, produced by the compression forming is allowed to exist at the inner peripheral side. As a result of the forging step, the projections are deformed to become thick in radial directions due to the compression so that the thin fins 7*a* are not subjected to a heavy load. Additionally, substantially equal loads are applied to the fins 7*a* from the opposite lateral sides. Therefore, fins 7*a* will not be damaged if they do not show a very high strength.

With a vibrating body 23 having such a profile, a mass sufficient for satisfactorily securing energy of vibration can be secured for the projections of the vibrating body and the grooves formed between adjacent projections can be made to show a minimal width to improve the abrasion-resistance of the projections that are brought into contact with the vibrating body. The profile of the vibrating body 23 produced after the forging step may not necessarily be same as the one illustrated in FIG. 7 so long as the radial width, or the plate thickness, of the projections 13*a* is raised by the forging step. Alternatively, for example, the radial width of the projections 13*a* and those of the base sections 13*b* of the crown-shaped member 13 may be equally increased or the radial width of only the projections 13*a* may be increased.

Figure 8:
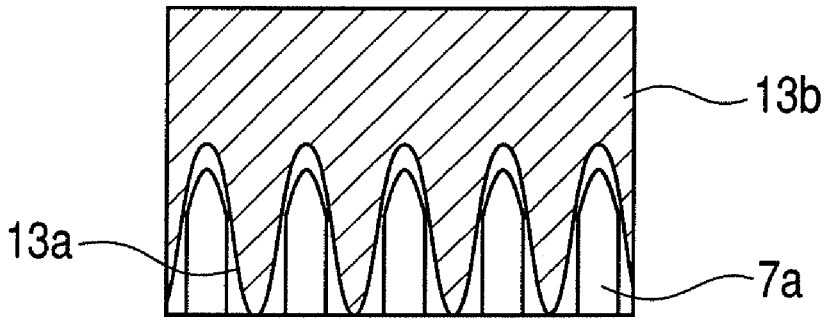
FIG. 8 is a schematic illustration of the relationship between the profile of the fins of a die and that of the projections of a crown-shaped member in the forging step of the first embodiment.

FIG. 8 is a schematic illustration of the relationship between the profile of the fins 7*a* of a die 7 and that of the projections 13*a* of a crown-shaped member 13 in the forging step, where some of the circularly arranged fins 7*a* are extended on a straight line. Before the forging step, the projections of the crown-shaped member 13 are made higher than the fins 7*a* of the die 7 to secure a sufficient volume for the projections 23*a* after the forging step.

Figure 9:
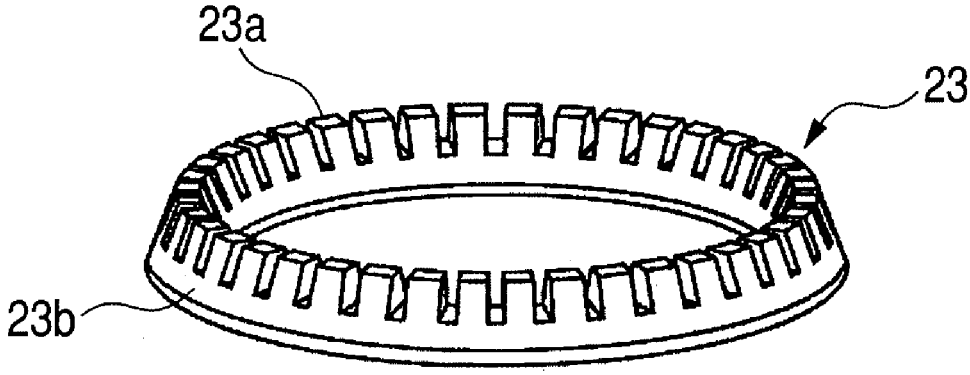
FIG. 9 is a schematic perspective view of a vibrating body by compression forming in the forging step of the first embodiment.

FIG. 9 is a schematic perspective view of a vibrating body 23 compressed and formed by forging. A piezoelectric element that is an electro-mechanical transducer is rigidly fitted to the bottom surface of the vibrating body 23 and an electrode pattern that matches the form of vibrations produced to the vibrating body by excitation is formed on the piezoelectric element. A plurality of standing waves are generated in the vibrating body as an alternating voltage is applied to the electrode pattern and a traveling wave is formed on the surface of the vibrating body 23 when the plurality of standing waves are generated simultaneously. The amplitude of the traveling wave generated on the surface of the vibrating body 23 can be boosted by arranging projections 23*a* along the circumferential end facet of the vibrating body 23. Thus, outputs as an ultrasonic motor can be improved. The projections 23*a* that are arranged to appear like a ring are held in contact with a ring-like rotating body (not illustrated) and the rotating body is driven to rotate by the traveling wave that is generated on the surface of the vibrating body 23 and whose displacement is boosted by the projections 23*a*.

Increasing the width of the projections produced by compression forming on the vibrating body of an ultrasonic motor is advantageous not only for improving the abrasion-resistance but also for suppressing unnecessary vibrations. The profile of the projections of the vibrating body is preferably such that it provides a large volume to the projections relative to the surface area thereof because the projections have few proper vibration modes and the frequencies of the proper vibration modes are high with such a profile so that unnecessary vibrations can hardly occur due to the projections themselves. If a crown-shaped member 13 produced as a result of the drawing is used as a vibrating body without any subsequent process, the projections 13*a* show a small radial width. If an alternating voltage is applied to the piezoelectric element to generate vibrations in the vibrating body under this condition, proper vibrations are generated in the projections 13*a* to make it vibrate in radial directions like so many cantilevers, which are unnecessary vibrations. Thus, increasing the radial width of the projections 13*a* by compression forming to raise the radial rigidity thereof against vibrations provides an advantage of suppressing unnecessary vibrations attributable to the projections 13*a*.

Figure 21:
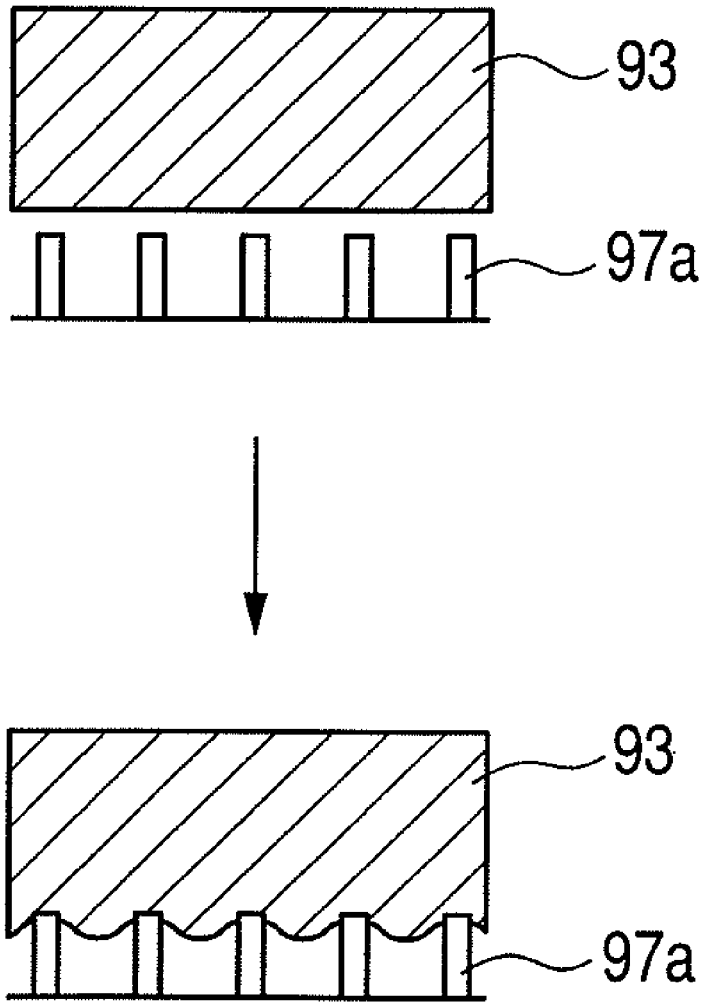
FIG. 21 is a schematic illustration of a known step of forming a plurality of projections by sheet metal stamping.

Now, some of the results obtained by comparing the known method of forming projections on an object to be worked having no projections by forming grooves, using a die having fins, as illustrated in FIG. 21 and this embodiment of method according to the present invention will be described below.

With this embodiment, the final profile of the vibrating body to be formed is a ring-like vibrating body having an outer diameter of 62 mm and the radial width and the height of the base section thereof is 5 mm and 5.4 mm respectively while the radial width and the height of the front end sections of the projections are 1 mm and 2.7 mm respectively. The die and the punch are made of high-speed steel and the circumferential width and the height of each of the fins of the die prepared by electric discharge machining are 0.6 mm and 2.7 mm respectively.

In an experiment, a ring-like object to be worked having the above-cited dimensions including the outer diameter and the widths was forged to form grooves separating projections by means of a punch and a die having fins as illustrated in FIG. 21.

However, it was not possible to satisfactorily produce projections and the metal die was broken in the course of the process of producing projections having rounded front end sections.

With the method illustrated in FIG. 21, the object to be worked is sheared by the fins so that fresh surfaces newly appear on the sheared sites to give rise to a lubricant shortage and make the pushing process a difficult one. When an object to be worked that is apt to give rise to a phenomenon of plastic flow is forged without a special arrangement for making lubricant follow the deformation of the object that is being worked, a lubricant shortage takes place as the object is deformed to give rise to seizure and/or some other trouble. Therefore, a process of integrally producing a chemical conversion coating film and a lubricant ingredient that reacts with the coating film is generally executed on the surface of the object to be worked in order to secure lubricant for the forging process.

However, a chromium passive coating film that contributes to raise the degree of anti-corrosiveness is formed on the surface of stainless steel to make it difficult to produce a uniform chemical conversion coating film on the surface thereof. Additionally, many different types of stainless steel show a high strain hardening coefficient and hence are hardened when subjected to compression deforming to increase the deformation resistance thereof and make it difficult to produce a complex profile by forging.

To the contrary, with this embodiment, stainless steel is not sheared by compression forming and no site where any local deformation is boosted appears to make it easy to execute a compression forming process on stainless steel, although it has been difficult to make stainless steel show a desired profile by forging.

For example, for a compression forming process for forming a vibrating body made of martensite-based stainless steel SUS420j2 and showing the above-described final profile, the known method illustrated in FIG. 21 requires a load of 300 tons or more while this embodiment requires only a load of 120 tons. Furthermore, some of the fins of the die were broken when an object to be worked is pushed down by a punch on the die by means of the former method.

When manufacturing a product from an object to be worked by compression forming such as forging, not only the load of the metal die is reduced and the service life of the metal die is prolonged but also seizure due to a lubricant shortage can be prevented from taking place by minimizing the load necessary for the compression forming. Additionally, an effect of reducing the extent of springing back and improving the dimensional accuracy of the formed product is also achieved by reducing the load necessary for the compression forming. Furthermore, the compression forming process can be executed by means of a small press machine when the load necessary for the compression forming is reduced.

With the known manufacturing method illustrated in FIG. 21, all the load applied to the die is concentrated to the fine fins that are held in contact with the object to be worked so that the stress there becomes very large to eventually damage the fins. Additionally, this process is sort of an extrusion process, and a lubricant shortage is likely to take place at the areas of the surface of the object to be worked that contact the fins so that so-called fresh surfaces appear there to give rise to seizure at the fins. To the contrary, when projections are formed on the object to be worked in advance before the object is forged according to the present invention, the projections are crushed to fill the inside of the die and the process of forming the parts other than the projections proceeds simultaneously so that no large local stress may appear in the metal die.

Thus, unlike the known method illustrated in FIG. 21, this embodiment of the present invention does not require any load for pushing the projections to remarkably reduce the load necessary for compression forming.

Alternatively, for the purpose of accurately determining the positions of the bottoms of the grooves between the projections 13*a*, the volume of the projections 13*a* of the crown-shaped member 13 may be made smaller than that of the projections 23*a* of the vibrating body 23 and the projections 23*a* may be formed to a small extent after bringing the tops of the fins 7*a* into contact respectively with the bottoms of the grooves between the projections 13*a*. Note that, if the volume of the projections 13*a* of the crown-shaped member 13 is too large, the projections 13*a* may fill the spaces between fins 7*a* firstly to give rise to insufficiently bent fins. Therefore, the volume of the projections 13*a* of the crown-shaped member 13 is preferably made smaller than that of the projections 23*a* of the vibrating body 23. With this arrangement, the compression forming is completed with a relatively small load in the forging step, and no heavy load is applied to metal die to make the metal die practically free from troubles such as damage and/or seizure.

Additionally, the crown-shaped member may preferably have such a profile that the process of forming the projections and that of forming the base sections are completed substantially at the same time so that no heavy load is applied to the fins of the metal die and the entire forming process is completed in a state where the top end facets of the fins are respectively held in tight contact with the bottoms of the grooves.

As described above, with this embodiment, firstly a plate member processed to show a profile having a plurality of projections is prepared and the plate member is then bent so as to direct the projections in the same direction. In other words, the plate member is bent so as to make the projecting direction of the plurality of projections include a component in an out-of-plane direction. Subsequently, the plate thickness of the plurality of projections of the plate member is raised and a load is applied to the projections in the standing direction of the projections (namely in the direction including a component in an out-of-plane direction) for compression forming so as to make the projections, which are now projecting in the same direction, show a desired profile.

To the contrary, when a gear or a vibrating body having a plurality of projections projecting in the same direction is manufactured from an object to be worked by grinding or cutting so as to make the projections show a desired width, the grinding or cutting process will be time consuming and it may not be suited for mass production. When projections are formed by forming grooves on an object to be worked only by sheet metal stamping or forging, the width of the projections will have to be limited because of the limit that needs to be imposed to the load to be applied to the metal die as pointed out earlier. Still additionally, when a crown-shaped member is manufactured simply by bending a plate member having a plurality of projections projecting in radial directions so as to direct the projections in the same direction, the plate thickness of the projections should necessarily be made small.

This embodiment dissolves the above-identified problems and is remarkably advantageous relative to the known methods because it requires neither grinding nor cutting, and the grooves separating the projections can be made to have any desired width, and thus the load applied to the metal die in the compression forming process is reduced.

While the above-described embodiment employs punching for processing a plate member having a plurality of projections projecting in radial directions in the above description, the present invention is by no means limited to punching. For example, a plurality of grooves may be formed on the outer periphery of a disk-shaped member by wire cutting. In such a case, a high efficiency can be achieved by laying a large number of disk-shaped members one on the other for a wire cutting process. Alternatively, a rod-shaped member or a tubular member having a plurality of axially extending grooves may be sliced. Still alternatively, a plate member having a plurality of projections projecting in radial directions that is prepared in advance may be brought in.

While the above-described embodiment employs drawing for bending a plate member and making the projecting direction of the projections include a component in an out-of-plane direction, the present invention is by no means limited thereto. For example, a plate member may be bent alternatively by burring, bulging or dibbling (for forming a conic shape).

While the above-described embodiment employs forging for applying a load to the projections of a metal member whose projecting direction includes a component in an out-of-plane direction to increase the plate thickness of the projections of metal member, the present invention is by no means limited therefore. For example, the plate member may be processed by hot forging, warm forging or heading.

Second Embodiment

Now, the second embodiment of a method of manufacturing a metal member having a plurality of projections according to the present invention will be described in terms of a vibrating body having projections on the surface thereof for amplifying vibrations. This embodiment differs from the first embodiment in terms of the process of compression forming a crown-shaped member 13 after a drawing step.

Figure 10:
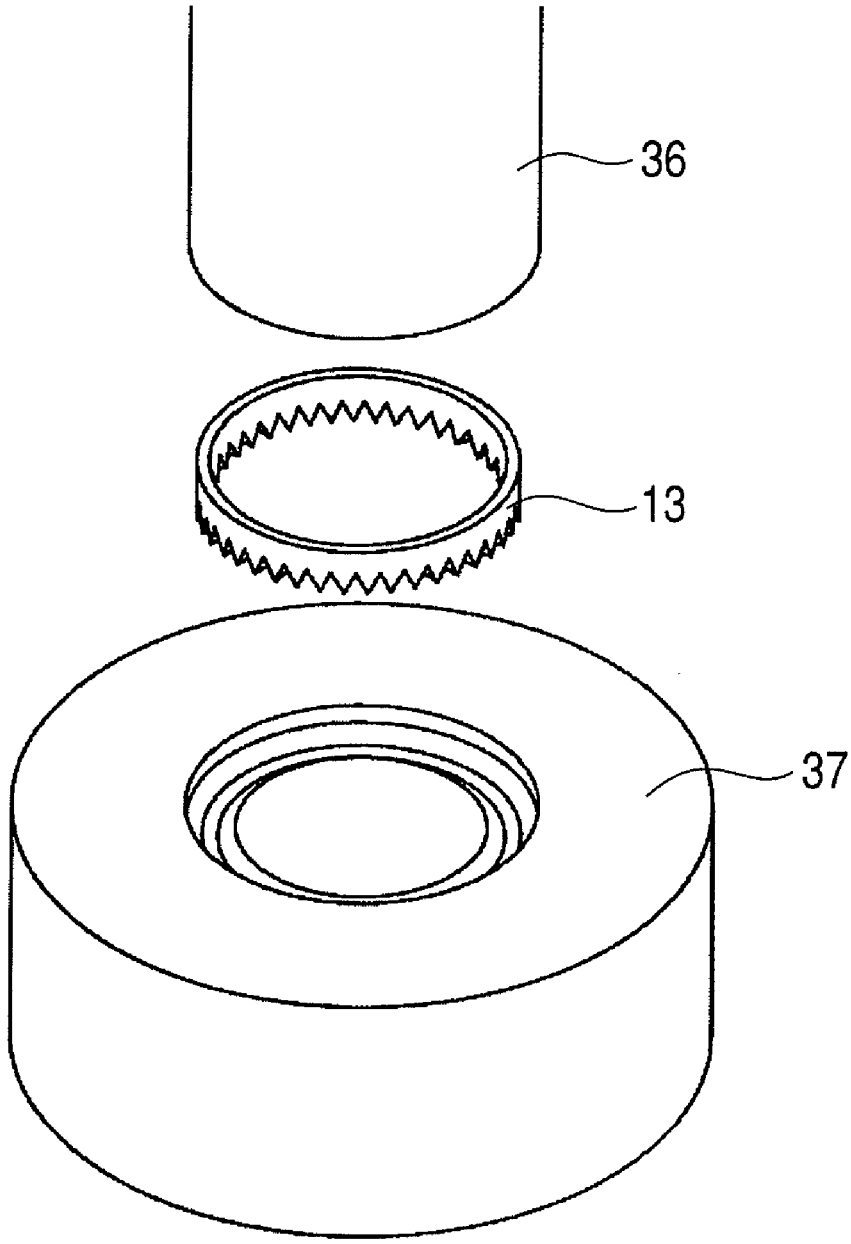
FIG. 10 is a schematic illustration of the first forging step of forging a crown-shaped member in a second embodiment of the present invention.
Figure 11:
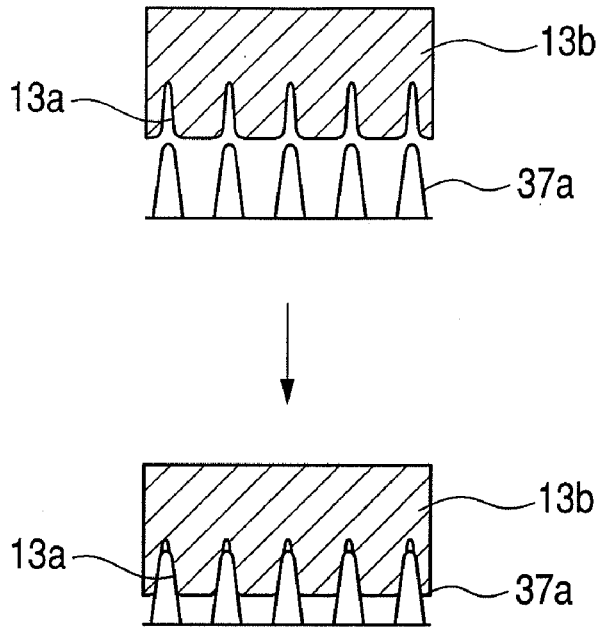
FIG. 11 is a schematic illustration of the second forging step of forging a crown-shaped member in the second embodiment.

FIG. 10 is a schematic illustration of the first forging step of forging a crown-shaped member 13 by the second embodiment. FIG. 11 is a schematic illustration of the second forging step of forging a crown-shaped member. The crown-shaped member 13 is formed by means of a punch 36 and a die 37. In this embodiment, the crown-shaped member 13 is turned upside down and a load is applied thereto for forging, or compression forming, just as in the first embodiment but this embodiment differs from the first embodiment in that the die 37 that is employed in this embodiment does not have any fins 37.

With this embodiment, the radial width (plate thickness) of the crown-shaped member 13 is raised at the projections 13*a* and the base sections 13*b* and the crown-shaped member 13 is deformed to show a profile of having a thickness extending between the outer peripheral wall and the inner peripheral wall of the groove of the die 37 in the first forging step that employs a die 37 having no fins. Then, the crown-shaped member 13 that is forged in the first forging step is subjected to the second forging step by means of a metal die having fins 37*a*, where the grooves separating the projections 13*a* are broadened by the respective fins 37*a* to produce a vibrating body 23 showing a final profile.

A more accurately processed product may be obtained by crushing the projections in advance in order to raise their width and then broadening the grooves to a desired width. The front end parts of the fins 37*a* are preferably rounded in order to allow the fins 37*a* to smoothly get into the respective grooves.

Third Embodiment

Now, the third embodiment of a method of manufacturing a metal member having a plurality of projections according to the present invention will be described in terms of a vibrating body having projections on the surface thereof for amplifying vibrations. This embodiment differs from the first and second embodiments in the process preceding the forging.

Figure 12:
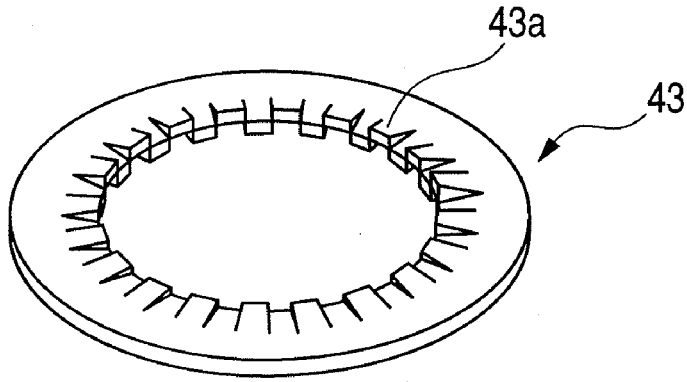
FIG. 12 is a schematic illustration of a flat ring member of stainless steel sheared by sheet metal stamping in a third embodiment of the present invention.

FIG. 12 is a schematic illustration of a flat ring member 43 sheared by sheet metal stamping. More specifically, the ring member 43 is sheared by sheet metal stamping at an inner peripheral part thereof to deform the inner peripheral part and produce a plurality of sheared sections out of the inner peripheral part that are bent alternately in opposite directions. Thus, a plurality of cut and bent sections 43*a* are arranged in radial directions as viewed from the axis, or the center, of the ring member. The cut and bent sections 43*a* are projections projecting in different directions as viewed from the in-plane direction of the plate member.

Figure 13:
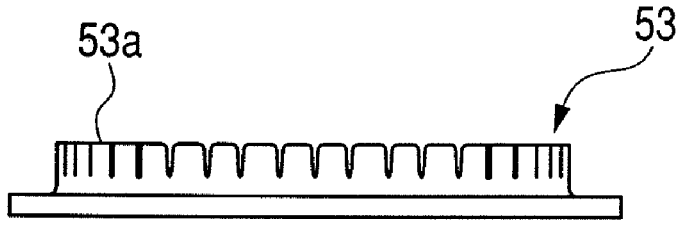
FIG. 13 is a schematic illustration of a ring member produced by burring in the third embodiment.
Figure 14:
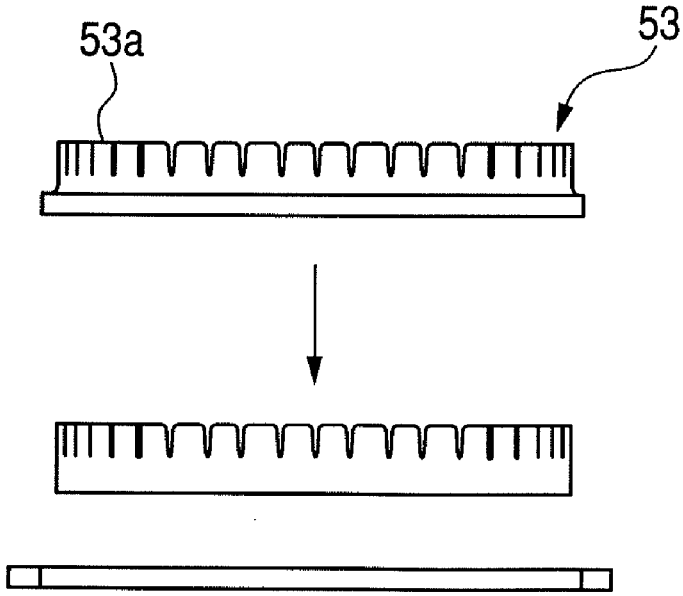
FIG. 14 is a schematic illustration of punching out an outer peripheral part of the crown-shaped member of FIG. 13.

FIG. 13 is a schematic illustration of a ring member 43 produced by burring. The ring member 43 having the cut and bent sections 43*a* produced by sheet metal stamping is then subjected to a burring process to obtain a crown-shaped member 53 where the cut and bent sections 43*a* extend in the same direction running along the axis of the ring member 43 and are separated from each other as illustrated in FIG. 13. The ring member 43 may be subjected to a process of turning all the deformed directions of the cut and bent sections 43*a* in the same direction before the burring process. Then, the crown-shaped member 53 having projections 53*a* that are directed in the same direction is subjected to a press-punching process to cut out an outer part of the crown-shaped member 53 along a circular line located outside the positions where the cut and bent sections 43*a* are bent in the burring process.

Since the cut and bent sections 43*a* of the ring member 43 are tapered in terms of width, the gaps separating adjacent ones of the projections 53*a* increases toward the front ends of the projections 53*a* of the crown-shaped member 53. Therefore, the crown-shaped member 53 can be aligned with ease with the fins arranged at the metal die for the forging process.

Since the cut and bent sections 43*a* are produced by shearing with this embodiment, no circumferential gaps are produced between adjacent ones of the cut and bent sections 43*a*. Therefore, a large volume can be secured for the projections with this embodiment if compared with the first embodiment with which projections are formed by notching a plate member. Additionally, a large number of cut and bent sections 43*a* can be formed if compared with projections formed by punching. Furthermore, such cut and bent sections 43*a* can be made long if compared with projections formed by punching.

As described above, each of the above-described embodiments utilizes a plate member where a plurality of projections extending in radial directions are formed in advance and executes a compression forming process after a bending process so that it requires neither grinding nor cutting. Additionally, the plurality of projections that are made to project in the same direction can be made to show a desired width, although the load applied to the metal die in the compression forming process is reduced.

Fourth Embodiment

Now, the fourth embodiment of a method of manufacturing a metal member having a plurality of projections will be described in terms of a vibrating body having projections on the surface thereof for amplifying vibrations. This embodiment differs from the above-described third embodiment in that a plurality of cut and bent sections are formed in an outer peripheral part of a plate member by shearing.

Figure 15:
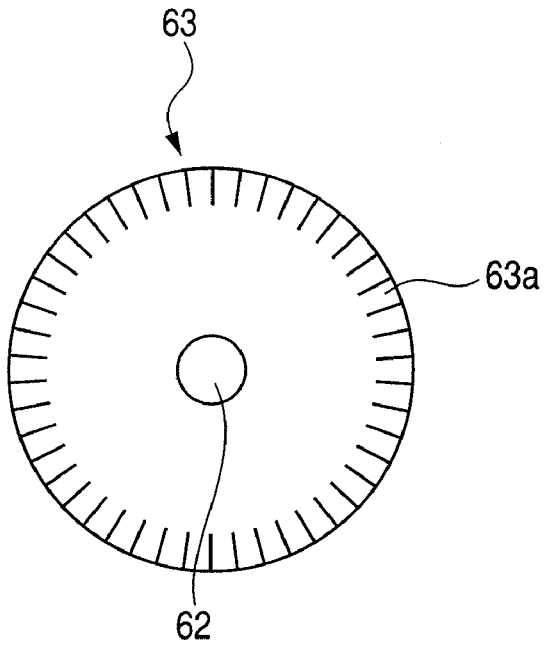
FIG. 15 is a schematic illustration of a flat ring member sheared from a stainless steel plate by sheet metal stamping in a fourth embodiment of the present invention.

FIG. 15 is a schematic illustration of a flat ring member 63 sheared from a stainless steel plate by sheet metal stamping. More specifically, the ring member 63 is sheared by sheet metal stamping at an outer peripheral part thereof to deform the outer peripheral part and produce a plurality of sheared sections out of the outer peripheral part that are bent alternately in opposite directions. Thus, a plurality of cut and bent sections 63*a* are arranged in radial directions as viewed from the axis, or the center, of the ring member. FIG. 15 illustrates an inner hole 62 for centering the ring member 63 for the shearing process.

Figure 16:
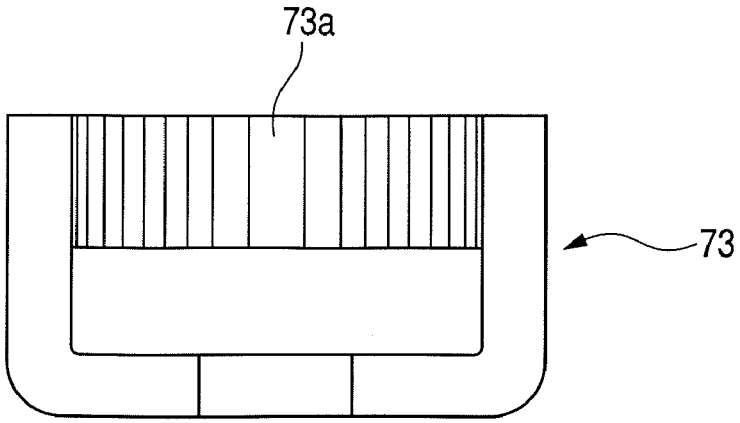
FIG. 16 is a schematic illustration of a crown-shaped member obtained by drawing a ring member in the fourth embodiment.

FIG. 16 is a schematic illustration of a crown-shaped member 73 obtained by drawing a ring member 63. The ring member 63 having the cut and bent sections 63*a* produced by sheet metal stamping is then subjected to a drawing process to obtain a crown-shaped member 73 where the cut and bent sections 63*a* extend in the same direction running along the axis of the ring member 63 as illustrated in FIG. 13. Since the cut and bent sections are arranged at an outer peripheral part of the ring member 63 unlike the third embodiment, the cut and bent sections have a width that increases toward the front ends thereof. Therefore, when a crown-shaped member is produced by drawing, the gaps separating the projections 73*a* are not broadened but the projections remain in a state where adjacent ones adhere to each other. Or, rather, the height of the projections is increased by the drawing process.

Figure 17:
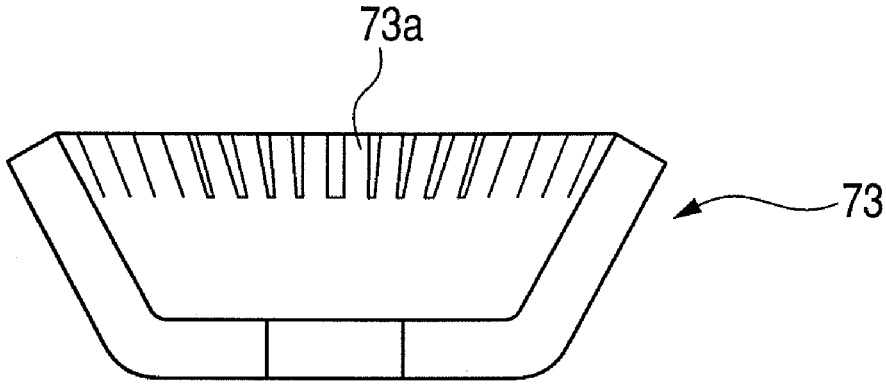
FIG. 17 is a schematic illustration of a crown-shaped member produced by pushing and spreading out front end parts of the projections thereof by means of a tapered punch in the fourth embodiment.
Figure 18:
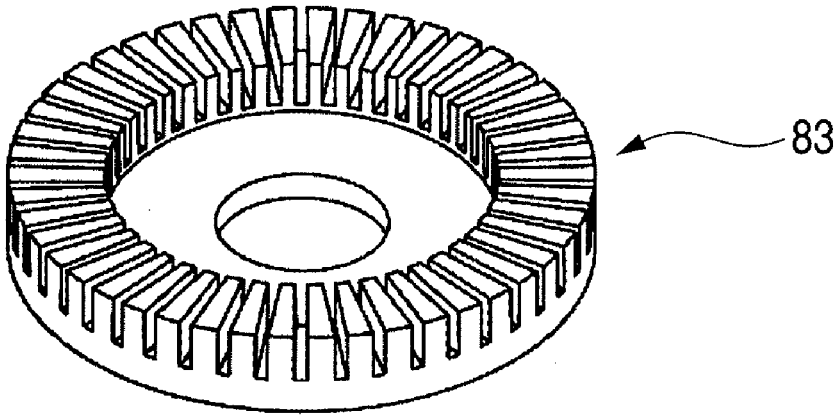
FIG. 18 is a schematic perspective view of a vibrating body formed by forging in the fourth embodiment.

FIG. 17 is a schematic illustration of the crown-shaped member 73 produced by pushing and spreading out front end parts of the projections thereof by means of a tapered punch. As described above, after the drawing process, the projections 73*a* of the crown-shaped member 73 remain in a state where adjacent ones adhere to each other so that the gaps separating the front end parts of the projections 73*a* are preferably broadened by pushing and spread out the front end parts of the projections 73*a* by means of a punch having tapered fins. Then, the crown-shaped member 73, the gaps separating the projections 73*a* thereof are broadened, is forged, while the plate thickness is being raised, to obtain a vibrating body 83 as illustrated in FIG. 18.

Figure 19:
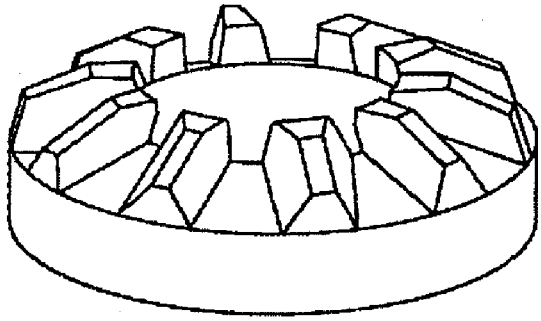
FIG. 19 is a schematic perspective view of a bevel gear that can be produced by applying any of the embodiments of forming method according to the present invention.
Figure 20:
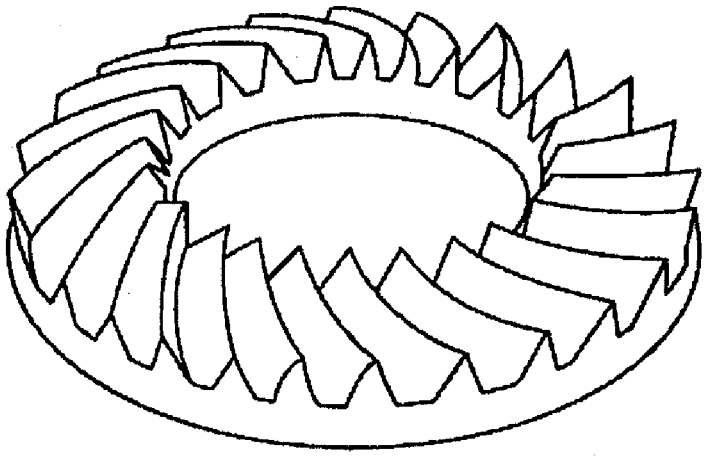
FIG. 20 is a schematic perspective view of a hypoid gear that can be produced by applying any of the embodiments of forming method according to the present invention.

The preferred embodiments are described above in terms of forming projections for amplifying vibrations of a vibrating body. However, the present invention is by no means limited thereto. Those skilled in the art will easily realize that a forming method according to the present invention can find applications in bevel gears as illustrated in FIG. 19, hypoid gears as illustrated in FIG. 20 and other similar metal-made objects so long as they are formed from a metal object to be worked that has a plurality of projections projecting in the same direction.

This application claims the benefit of Japanese Patent Application No. 2008-014459, filed Jan. 25, 2008, which is hereby incorporated by reference herein in its entirety.

The invention claimed is:

1. A method of manufacturing a metal member having a plurality of projections, comprising:

a step of bending a plurality of projections of a metal-made plate member having the plurality of projections so as to make their projecting direction include a component of an out-of-plane direction; and a step of applying a load having the component of the out-of-plane direction to the plurality of projections to increase the plate thickness of the plurality of projections.

2. The method according to claim 1, wherein the metal-made plate member is a circular plate member with the plurality of projections formed along the inner periphery or the outer periphery thereof; and the plate member is bent to form a cylinder by the plurality of projections in the bending step.

3. The method according to claim 2, wherein the load is applied to the plurality of projections in a direction running along an axis of the cylinder to increase the thickness of the plurality of projections in a radial direction of the cylinder in the step of increasing the plate thickness of the plurality of projections.

4. The method according to claim 1, further comprising:

a step of forming the metal-made plate member having a plurality of projections by punching out a metal-made plate.

5. The method according to claim 1, further comprising:

a step of forming the metal-made plate member having the plurality of projections by shearing a metal-made plate.

6. The method according to claim 1, wherein the step of directing the projections to the projecting direction including a component of the out-of-plane direction is realized by drawing, burring, bulging or dibbling.

7. The method according to claim 1, wherein the step of increasing the plate thickness of the projections is realized by forging or heading.

* * * * *